US007063555B1

(12) United States Patent
Mullen

(10) Patent No.: US 7,063,555 B1
(45) Date of Patent: Jun. 20, 2006

(54) QUICK RELEASE CONNECTOR FOR LIGHT BULB

(76) Inventor: Nate Mullen, 1240 Simpson Way, Escondido, CA (US) 92029

( * ) Notice: Subject to any disclaimer, the term of this patent is extended or adjusted under 35 U.S.C. 154(b) by 193 days.

(21) Appl. No.: 10/448,545

(22) Filed: May 30, 2003

(51) Int. Cl.
*H01R 13/627* (2006.01)

(52) U.S. Cl. ..... 439/364

(58) Field of Classification Search ..... 439/364, 439/370, 133, 334, 460, 86, 274, 461–462, 439/699.2; 362/147, 404, 226, 96, 457
See application file for complete search history.

(56) References Cited

U.S. PATENT DOCUMENTS

| | | | | |
|---|---|---|---|---|
| 2,455,829 | A | 12/1948 | R. B. Thomas et al. | |
| 3,320,466 | A | 5/1967 | R. J. Ayers et al. | |
| 3,633,149 | A | 1/1972 | Maltais | |
| 3,842,302 | A | 10/1974 | Apostoleris | |
| 4,061,940 | A | 12/1977 | Fitzgerald et al. | |
| D269,778 | S | 7/1983 | McGregor | |
| 4,428,032 | A | 1/1984 | Workman | |
| 4,473,770 | A | 9/1984 | Baba et al. | |
| 4,886,994 | A | 12/1989 | Ragge, Jr. | |
| 5,458,504 | A * | 10/1995 | Lostumo et al. | 439/460 |
| 5,609,410 | A | 3/1997 | Rives | |
| 5,615,944 | A | 4/1997 | Siegfried et al. | |
| 5,634,823 | A * | 6/1997 | Furuta et al. | 439/699.2 |
| D404,358 | S | 1/1999 | Sato et al. | |
| 5,937,140 | A * | 8/1999 | Leonard et al. | 392/392 |
| 5,964,598 | A * | 10/1999 | Gonzales | 439/133 |
| 6,242,853 | B1 * | 6/2001 | Mulholland | 313/318.01 |
| 6,270,235 | B1 * | 8/2001 | Coushaine | 362/226 |
| 6,322,232 | B1 * | 11/2001 | Oliver | 362/147 |
| 6,509,678 | B1 * | 1/2003 | Shen | 313/318.01 |
| 6,917,754 | B1 * | 7/2005 | Pedrotti et al. | 392/395 |
| 2003/0173203 | A1 * | 9/2003 | Miki | 200/529 |

* cited by examiner

*Primary Examiner*—J. F. Duverne
(74) *Attorney, Agent, or Firm*—Kelly Lowry & Kelley, LLP

(57) ABSTRACT

The connecting apparatus for facilitating installing, maintaining and replacing light bulbs comprises a non-conductive base grip including two electrodes manufactured from conductive material embedded in the base grip. The two electrically conductive electrodes are electrically isolated from each other and comprise a clamping structure and a prong. The clamping structure is designed to "clamp" or "grip" onto posts or screws on a light bulb. The prong provides a point for "hot" and "neutral" electrical leads to enter or leave the connecting apparatus. The clamping structures are applied with slight pressure to posts or screws on a light bulb and remain applied through the use of a gripping force or friction.

13 Claims, 3 Drawing Sheets

QUICK RELEASE CONNECTOR FOR LIGHT BULB

CROSS-REFERENCE TO RELATED APPLICATION

Not Applicable.

STATEMENT RE: FEDERALLY SPONSORED RESEARCH AND DEVELOPMENT

Not Applicable.

BACKGROUND OF THE INVENTION

1. Field of the Invention

This invention relates to an apparatus, i.e., a connecting structure, which facilitates connecting, removing, and replacing light bulbs in a lighting fixture. In particular, the apparatus is designed to operate with a PAR-36 light bulb or any other similar bulb which has separate positive and negative post and/or screw connectors on the light bulb requiring additional effort to secure the electrical source to the light bulb, i.e., tightening screws or soldering wires. While this apparatus was designed to function with a PAR-36 light bulb, the principles and teachings of this invention are applicable to other types of light bulbs with similar types of postive and negative electrical connections.

2. Description of the Related Art

The prior art encompasses several structures for securing light bulbs to an electrical source, including: a threaded, screw-in bulb; a plug-in bulb; a solder connection; and a set screw. Drawbacks of these prior art structures include, in some cases, difficulty in the installation and/or replacement of the light bulb. Another drawback is that they can also result in time consuming labor where there are many light bulbs which are required to be replaced over a large area, i.e. in large landscaping and/or commercial projects.

BRIEF SUMMARY OF THE INVENTION

The main object of this invention is to provide an apparatus which facilitates installing a light bulb in a light fixture.

Another object of this invention is to provide an apparatus which facilitates exchanging a light bulb in a light fixture.

A further object of this invention is to provide an apparatus which expedites installing a light bulb in a light fixture, thereby saving time and money.

A still further object of this invention is to provide an apparatus which expedites exchanging a light bulb in a light fixture thereby saving time and money.

It is another object of this invention to provide an apparatus which provides a more secure manner of connecting an electrical source to a light bulb.

The connecting structure of the present invention comprises a base grip including two electrodes manufactured from conductive material embedded in the base grip. Each of the two metal electrodes are electrically isolated from each other and comprise a clamping structure and a prong. The clamping structure is designed to "clamp" or "grip" onto the posts or screws on the light bulb. The prong provides a point for electricity to enter or leave the connecting structure. The prong on the first electrode is the "hot" terminal and the prong on the second electrode is the "neutral" terminal.

DETAILED DESCRIPTION OF THE INVENTION

The instant invention is directed to a connecting apparatus for facilitating the installation and/or replacement of light bulbs in a lighting fixture. Specifically, the connecting apparatus is for use with PAR-36 light bulbs but the teachings will operate with any light bulb which possess two physically separate connection posts. The benefits of this invention are more realizable in large commercial or landscape lighting systems involving a large number of light fixtures where a great deal of time and expense is involved in installing, maintaining, and/or replacing such a large number of light bulbs. The ease and speed with which the light bulbs may be replaced is readily apparent to one skilled in the art.

Figure 5:
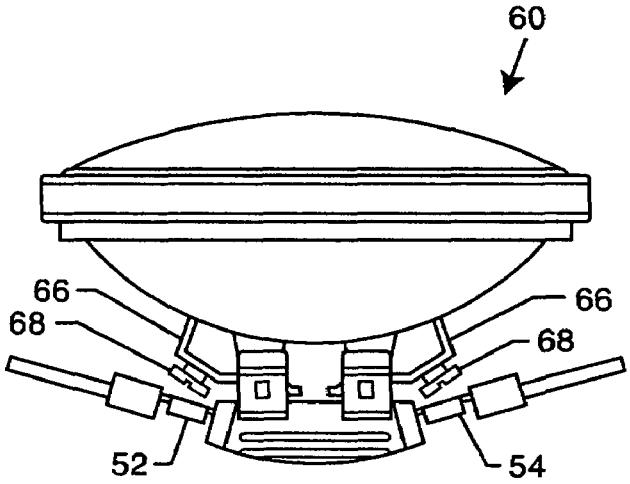
FIG. 5 shows a front view of the second preferred embodiment of the inventive apparatus connected to a PAR-36 light bulb and an electrical source.
Figure 6:
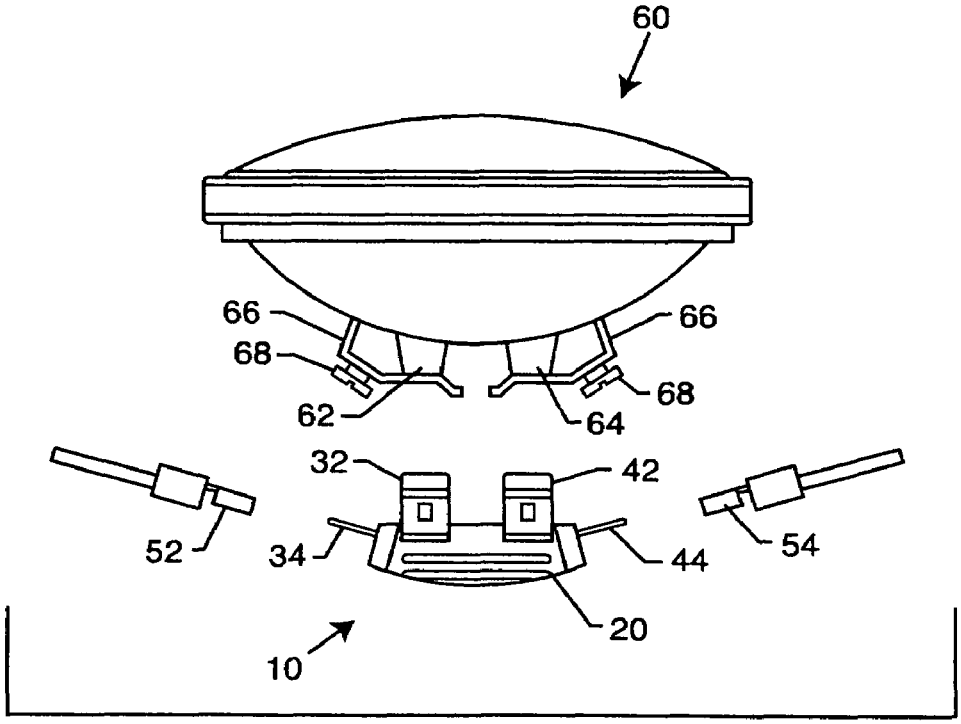
FIG. 6 shows an exploded front view of the second preferred embodiment of the inventive apparatus along with a PAR-36 light bulb and an electrical source.

Initially, FIGS. 5 and 6 depict a PAR-36 lightbulb (60) connected to and/or adjacent to a quick release connector (10). In each of these figures, the PAR-36 light bulb (60) is depicted with brackets (66) and screws (68). The brackets (66) present a point for electrical contact with the luminous elements contained within the PAR-36 light bulb (60). The screws (68) represent a prior art method of securing electrical leads to the brackets (66) for supplying electricity to the PAR-36 light bulb (60).

Figure 1A:
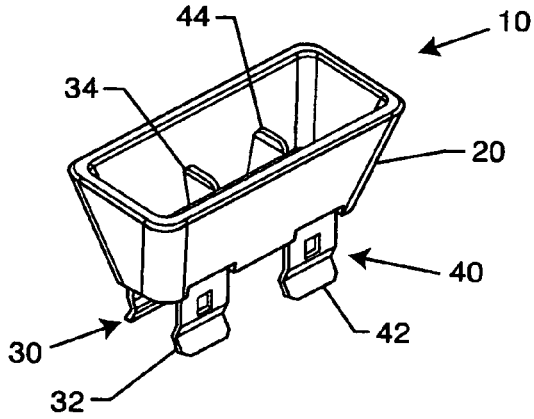
FIG. 1*a* shows an elevated perspective view of the first preferred embodiment of the inventive apparatus.
Figure 1B:
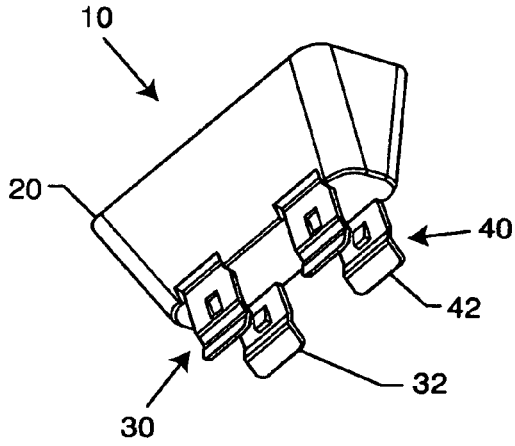
FIG. 1*b* shows a bottom perspective view of the first preferred embodiment of the inventive apparatus.
Figure 2A:
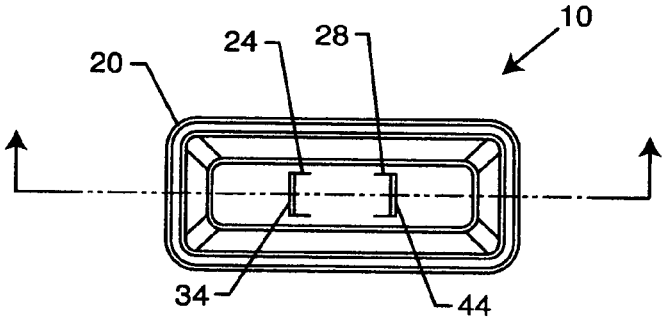
FIG. 2*a* shows a top view of the first preferred embodiment of the inventive apparatus.
Figure 2B:
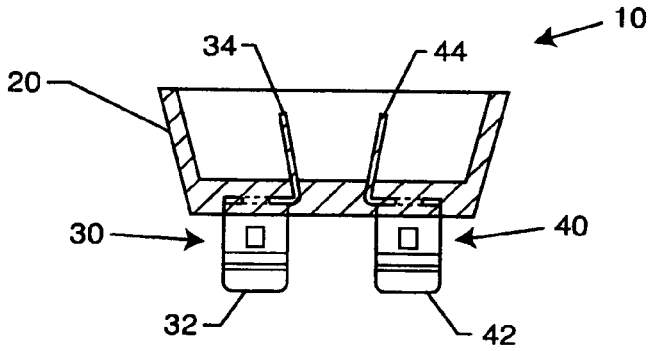
FIG. 2*b* shows a cross-sectional front view of the first preferred embodiment of the inventive apparatus.
Figure 3:
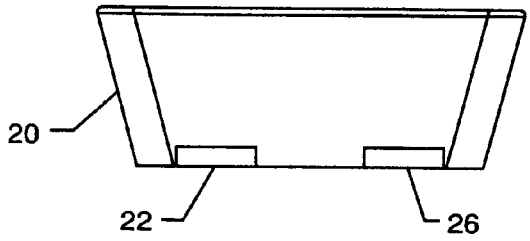
FIG. 3 shows a front view of the base grip of the first preferred embodiment of the inventive apparatus.
Figure 4A:
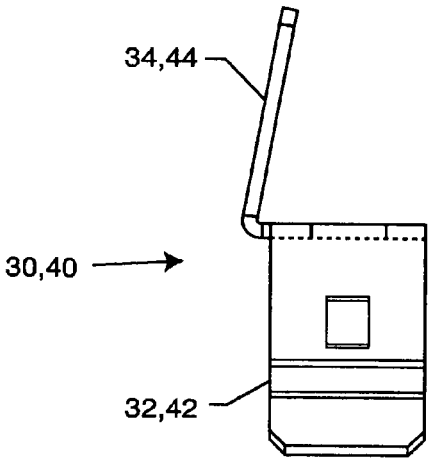
FIG. 4*a* shows a front view of one of the electrodes of the first preferred embodiment of the inventive apparatus.
Figure 4B:
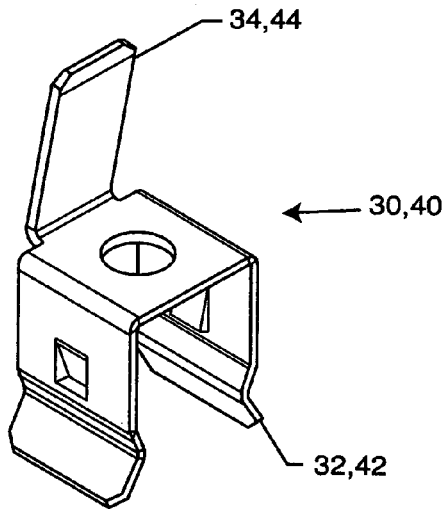
FIG. 4*b* shows an elevated perspective view of one of the electrodes of the first preferred embodiment of the inventive apparatus.

FIGS. 1*a* and 1*b* show perspective views of the first preferred embodiment of the instant invention. The quick release connector (10) comprises a base grip (20), which has a first and a second electrode (30 and 40) embedded therein. The first and a second electrodes (30 and 40) are embedded in the base grip (20) in a manner such that they are not in physical and/or electrical contact. The base grip (20) comprises first and second clamp openings (22 and 26) and first and second prong openings (24 and 28).

The base grip (20) is preferably manufactured from a rigid or hard rubber which is non-flexible and non-conductive. Alternatively, the base grip (20) may be manufactured from a soft, pliable rubber so long as the material is non-conductive and the first and second electrodes (30 and 40) do not come into physical and/or electrical contact with each other. As another alternative, the base grip (20) may be manufactured from any non-conductive material, such as ceramic or plastic, or any other non-conductive material commonly known to those having ordinary skill in the art.

The first and second electrodes (30 and 40), manufactured from an electrically conductive material, each comprise a clamp (32 and 42) and a prong (34 and 44). The clamp (32) on the first electrode (30) protrudes from the base grip (20) through the first clamp opening (22). The clamp (42) on the second electrode (40) protrudes from the base grip (20) through the second clamp opening (26). In a similar manner, the prong (34) on the first electrode (30) protrudes from the base grip (20) through the first prong opening (24). Further, prong (44) on the second electrode (40) protrudes from the base grip (20) through the second prong opening (28).

Each of the clamps (32 and 42), protrude from the base grip (20) such that they do not contact either the other clamp (42 or 32) or the prong (34 or 44) on the other electrode (30 or 40). Similarly, each of the prongs (34 and 44) protrude from the base grip (20) such that they do not contact either the other prong (44 or 34) or the clamp (32 or 42) on the other electrode (30 or 40). In the first preferred embodiment, the prongs (34 and 44) protrude from the top of the base grip (20) and the clamps (32 and 42) protrude from the bottom of the base grip (20). In the second preferred embodiment, shown in FIGS. 5 and 6, the prongs (34 and 44) protrude from the side of the base grip (20) and the clamps (32 and 42) protrude from the bottom of the base grip (20).

As shown in FIGS. 5 and 6, the prongs (34 and 44) act as a connection point for an electrical source comprising "hot" and neutral leads (52 and 54). Also as shown in FIGS. 5 and 6, the clamps (32 and 42) are in physical contact with terminal posts (62 and 64) on a light bulb (60). The clamps (32 and 42) are designed to securely fasten to the terminal posts (62 and 64) by means of pressure or friction. The quick release connector (10) may be easily attached to or removed from a light bulb (60) by simply pushing or pulling on the base grip (20) such that the clamps (32 and 42) move apart slightly to accommodate the terminal posts (62 and 64) of the light bulb (60).

For ease in explaining the operation of the quick release connector (10), this description will refer to the first electrode (30) as receiving the electrically "hot" lead (52) and the second electrode (40) as receiving the electrically neutral lead (54). In operation, either the first or second electrode (30 or 40) may receive the electrically "hot" lead (52) and the remaining second or first electrode (40 or 30) may receive the electrically neutral lead (54). The electrical source supplies electrical current to the prong (34) on the first electrode (30). The electrical current is then conducted through the first electrode (30) to the clamp (32) which in turn conducts the electrical current to one of the terminal posts (62) on the light bulb (60). The electrical current is then conducted out of the light bulb (60) through the other terminal post (64) and into the clamp (42) on the second electrode (40). Finally, the electrical current is conducted through the second electrode (40) to the prong (44) where it is conducted to the electrically neutral lead (54) thereby completing the electrical circuit.

To achieve the objects of the present invention, the electrical leads (52 and 54) are easily secured to and/or removed from the prongs (34 and 44), through the use of male/female connections. In both preferred embodiments, the electrical leads (52 and 54) are secured to the prongs (34 and 44) using a female electrical connector which slips over the male connector, the prongs (34 and 44). Alternatively, the electrical leads (52 and 54) may be secured to the prongs (34 and 44) through the use of screws, soldering and/or wire nuts, or any other method known to persons having ordinary skill in the art.

The above described invention is capable of being used in nearly any lighting system, whether it is high, standard or low voltage, or whether it is indoor or outdoor lighting. A skilled artisan will recognize that this invention may be used on its own or in combination with any of the other prior art embodiments in various lighting systems.

The above-described preferred embodiments are intended to illustrate the principles of the invention, but not to limit its scope. Other embodiments and variations of these preferred embodiments will be apparent to those skilled in the art and may be made without departing from the spirit and scope of the invention as defined in the following claims.

I claim:

1. A quick release connector apparatus releasably connectable to a light bulb comprising:

a base grip adapted for being grasped by a user;

a first electrode embedded within said base grip, said first electrode having a flexible clamp connectable to a terminal post on a lightbulb and a prong connectable to an electrical lead; and a second electrode embedded within said base grip, said second electrode having a flexible clamp connectable to a terminal post on a lightbulb and a prong connectble to an electrical lead.

2. The apparatus of claim 1, said base grip further comprising a first clamp opening and a second clamp opening.

3. The apparatus of claim 1, said base grip further comprising a first prong opening and a second prong opening.

4. The apparatus of claim 2, said base grip further comprising a first prong opening and a second prong opening.

5. The apparatus of claim 1 wherein the first electrode is electrically isolated from the second electrode.

6. A quick release connector apparatus releasably connectable to a light bulb comprising:

a base grip adapted for being grasped by a user;

said base grip comprising a first clamp opening and a second clamp opening;

said base grip comprising a first prong opening and a second prong opening;

a first electrode embedded within said base grip;

said first electrode comprising a flexible clamp connectable to a terminal post on a lightbulb and a prong configured for connection to an electrical lead;

a second electrode embedded within said base grip; and said second electrode comprising a flexible clamp connectable to a terminal post on a lightbulb and a prong configured for connection to an electrical lead.

7. The apparatus of claim 6, wherein said clamp of said first electrode protrudes from said base grip through said first clamp opening.

8. The apparatus of claim 6, wherein said clamp of said second electrode protrudes from said base grip through said second clamp opening.

9. The apparatus of claim 6, wherein said clamp of said first electrode protrudes from said base grip through said first prong opening.

10. The apparatus of claim 6, wherein said clamp of said second electrode protrudes from said base grip through said second prong opening.

11. The apparatus of claim 6, wherein the first electrode is electrically isolated from the second electrode.

12. A quick release connector apparatus releasably connectable to a light bulb comprising:

a base grip adapted for being grasped by a user;

said base grip comprising a first clamp opening and a second clamp opening;

said base grip comprising a first prong opening and a second prong opening;

a first electrode embedded within said base grip;

said first electrode comprising a flexible clamp connectable to a terminal post on a lightbulb and a prong configured for connection to an electrical lead, said clamp protruding from said base grip through said first clamp opening, and said prong protruding from said base grip through said first prong opening;

a second electrode embedded within said base grip; and said second electrode comprising a flexible connectable to a terminal post on a lightbulb clamp and a prong configured for connection to an electrical lead, said clamp protruding from said base grip through said second clamp opening, and said prong protruding from said base grip through said second prong opening.

13. The apparatus of claim 12, wherein the first electrode is electrically isolated from the second electrode.

* * * * *